US009437945B2

(12) United States Patent
Huo

(10) Patent No.: US 9,437,945 B2
(45) Date of Patent: Sep. 6, 2016

(54) ELECTRICAL CONNECTOR WITH IMPROVED TERMINAL

(71) Applicant: Molex, LLC, Lisle, IL (US)

(72) Inventor: Wei-Jie Huo, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/074,419

(22) Filed: Nov. 7, 2013

(65) Prior Publication Data

US 2014/0127918 A1 May 8, 2014

(30) Foreign Application Priority Data

Nov. 8, 2012 (CN) ..... 2012 2 0587443 U

(51) Int. Cl.

| | |
|---|---|
| ***H01R 12/57*** | (2011.01) |
| *H01R 13/658* | (2011.01) |
| *H01R 13/193* | (2006.01) |
| *H01R 12/50* | (2011.01) |
| *H01R 13/24* | (2006.01) |
| *H01R 13/41* | (2006.01) |

(52) U.S. Cl.

CPC ..... *H01R 12/57* (2013.01); *H01R 13/193* (2013.01); *H01R 13/2407* (2013.01); *H01R 13/41* (2013.01); *H01R 13/658* (2013.01); *H01R 23/6873* (2013.01)

(58) Field of Classification Search

CPC H01R 12/57; H01R 13/193; H01R 23/6873; H01R 13/65802; H01R 13/658

USPC ..... 439/83, 264, 268, 607.55, 607.56, 439/607.53, 607.54

See application file for complete search history.

(56) References Cited

U.S. PATENT DOCUMENTS

| | | | | |
|---|---|---|---|---|
| 7,232,316 | B2 * | 6/2007 | Chen | H01R 13/65802 439/607.01 |
| 7,467,975 | B2 * | 12/2008 | Ma | H01R 13/2442 439/607.01 |
| 8,314,881 | B2 | 11/2012 | Mizumura | |
| 2010/0265389 | A1 * | 10/2010 | Mizumura | H01R 13/2442 348/374 |

FOREIGN PATENT DOCUMENTS

| | | | |
|---|---|---|---|
| CN | 2789964 | Y | 6/2006 |
| CN | 101640360 | A | 2/2010 |
| JP | 63-98976 | A | 4/1988 |
| JP | 2006-140111 | A | 6/2006 |
| JP | 2008-027875 | A | 2/2008 |
| WO | WO 2006/042133 | A1 | 4/2006 |
| WO | WO 2011/014676 | A1 | 2/2011 |

* cited by examiner

*Primary Examiner* — Abdullah Riyami
*Assistant Examiner* — Justin Kratt
(74) *Attorney, Agent, or Firm* — James A. O'Malley; Stephen L. Sheldon

(57) ABSTRACT

An electrical connector and terminal for use therewith are disclosed. The terminal includes a securing portion extending along the vertical direction and provided with a plurality of bumps for fixing the terminal; a soldering portion bending and extending from the upper end of the securing portion to a first side of the securing portion. The terminal includes an arc bending portion, the arc bending portion extends from the lower end of the securing portion to the first side, and then extends through a bend to a second side opposite to the first side, the arc bending portion being hook shaped. The terminal includes a contact portion that extends obliquely and upwards from the arc bending portion toward the second side.

4 Claims, 8 Drawing Sheets

ELECTRICAL CONNECTOR WITH IMPROVED TERMINAL

RELATED APPLICATIONS

This application claims priority to Chinese Application No. 201220587443.1, filed Nov. 8, 2012, which is incorporated herein by reference in its entirety.

TECHNICAL FIELD

This invention relates to an electrical connector, especially to an electrical connector having a terminal with an improved flexible structure.

DESCRIPTION OF THE RELATED ART

An existing electrical connector for mounting an electronic module (for example, camera module, chip module and so on) is provided with a plurality of terminals for electrical connection with the electronic module, and the terminal is usually required to have good flexibility so as to keep a stable electrical connection with the electronic module. As shown in FIG. 12, the depicted structure of existing terminal 2*b* comprises: a horizontally extending soldering portion 22*b*, a securing portion 23*b* bending and extending vertically and downwards from the tail end of the soldering portion 22*b*, and an flexing contact portion 21*b* bending and extending obliquely and upwards from the tail end of the securing portion 23*b*. wherein, an arc transition section gradually bending and extending rightwards is connected between the contact portion 21*b* and the securing portion 23*b*, and referring to FIG. 13, when the electronic module is suitably accommodated in the receiving space of the electrical connector, the terminal 2*b* is subject to the pressure force of the electronic module and thus will move downwards from an original position P1 where it stays without being pressed to a working position P2. At this time, under the action of elastic resilience, the contact portion 21*b* of the terminal 2*b* will apply an elastic contact force onto the electronic module, so as to make sure that electrical contact between the terminal 2*b* and the electronic module is reliably maintained. At this time, a lower end of the securing portion 23*b* of the terminal 2*b* will outwards generate a lateral offset dl caused by deformation, and if the lateral offset d1 is too large, the terminal 2*b* and a cage of the electrical connector will be brought into contact, which can cause errors during signal transmission. After the electronic module is detached, the contact portion 21*b* of the terminal 2*b* will flex back upwards; however, the terminal 2*b* will experience some amount of yield (i.e. an amount of inelastic deformation) when it is pressed at the original position P2. Therefore, the terminal 2*b* can only flex back to another position lower than the original position P1. When the electronic module is plugged in and pulled out multiple times, the yield amounts of the terminal 2*b* will be accumulated and the contact force will decrease, which is disadvantageous to keep stable electrical connection with the electronic module. Therefore, improvements to the structure of the terminal of the electrical connector would be appreciated to reduce the yield amount and the lateral offset of the terminal, thus improving the elastic contact force of the terminal.

SUMMARY OF THE INVENTION

As can be appreciated, a terminal, which can be formed of a conductive material, includes a securing portion extending along the vertical direction and provided with a plurality of bumps for fixing the terminal. The terminal includes a soldering portion that extends from the upper end of the securing portion. The terminal further includes an arc bending portion, the arc bending portion has a first side that extends from the lower end of the securing portion and then bends and extends to a second side opposite to the first side to form a hook shape; and a contact portion, the contact portion extends obliquely and upwards from the tail end of the arc bending portion to the second side.

Embodiments of the terminal may include certain features. The securing portion may include two first surfaces with a plane face of wider width and two second surfaces with a plane face of narrower width, wherein an imaginary plane is defined by a first surface of the securing portion which faces the first side; one portion of the arc bending portion is located at a first side of the imaginary plane, and the other portion is located at a second side of the imaginary plane. In addition, the bumps can respectively extend outwards from the two second surfaces of the securing portion along a direction perpendicular to the second surfaces. In an embodiment, a surface of the arc bending portion which faces the surface of the first side is a smooth curved face; wherein a turning angle smaller than 180° and larger than 90° is formed between the smooth curved face and one first surface of the securing portion which face the first side. The soldering portion of the terminal can horizontally bend and extend from the upper end of the securing portion towards the first side of the securing portion. The soldering portion of the terminal can comprises a connecting section which bends downwards and extends from the upper end of the securing portion and a solder section which extends horizontally from the lower end of the connecting section. The terminal can be manufactured by integrally punching and bending a metal sheet, and a contact bump can be provided at the tail end of the contact portion.

An electrical connector is disclosed and includes a housing, a plurality of terminals fixed to the housing, and a cage fixed to the periphery of the housing; a receiving chamber is provided at the middle of the housing so as to correspondingly receive an electronic module, these terminals are terminals as described above, wherein the soldering portion of the terminal extends outwards from the cage, and the contact portion of the terminal extends inwards into the receiving chamber. The cage may comprise an upper cage and a lower cage; the upper cage including four sidewalls arranged to form an opening and a first shielding structure arranged on at least one of the sidewalls; the first shielding structure at least has a first horizontal extending portion and a first vertical extending portion, and covers the top of the soldering portion of the terminal so as to shield the soldering portion. A top edge of one sidewall of the upper cage can first extend horizontally outwards so as to form a second horizontal extending portion, and then vertically extend downwards from the outer edge of the second horizontal extending portion so as to form a second vertical extending portion; the second vertical extending portion is contacted with and continued with the housing; lower edge of the second vertical extending portion further extends so as to form the first horizontal extending portion and the first vertical extending portion. A plurality of grounding legs can extend downwards from a bottom edge of the first vertical extending portion.

DETAILED DESCRIPTION OF THE PREFERRED EMBODIMENTS

In the following, embodiments will be explained in details with reference to the accompanying drawings. As can be appreciated, the disclosure addresses the technical problem of providing an electrical connector and terminal thereof which can improve the elasticity of the terminal, reduce the amount of plastic deformation and the lateral offset of the terminal, and enhance the elastic contact force of the terminal. This can help ensure a stable electrical connection with the electronic module. By providing an arc bending portion which firstly bends and extends towards the first side and then bends and extends towards the second side, between the securing portion and the contact portion, the electrical connector and its terminal can significantly reduce the yield amount and the lateral offset of the terminal, and enhance the elastic contact force with respect to the electronic module, so as to ensure stable electrical connection with the electronic module.

Referring to FIG. 1 to FIG. 7, the electrical connector of a preferable embodiment of the invention comprises: the housing 1, a plurality of terminals 2 fixed on the housing 1, and an upper cage 3 and a lower cage 4 matched with each other and fixed to the periphery of the housing 1 (in some embodiments, the upper cage 3 and the lower cage 4 can be combined as one cage). During practical application, the electrical connector can be soldered to a circuit board (not shown in the Figures) and can be connected with an electronic module (not shown in the Figures).

Figure 6:
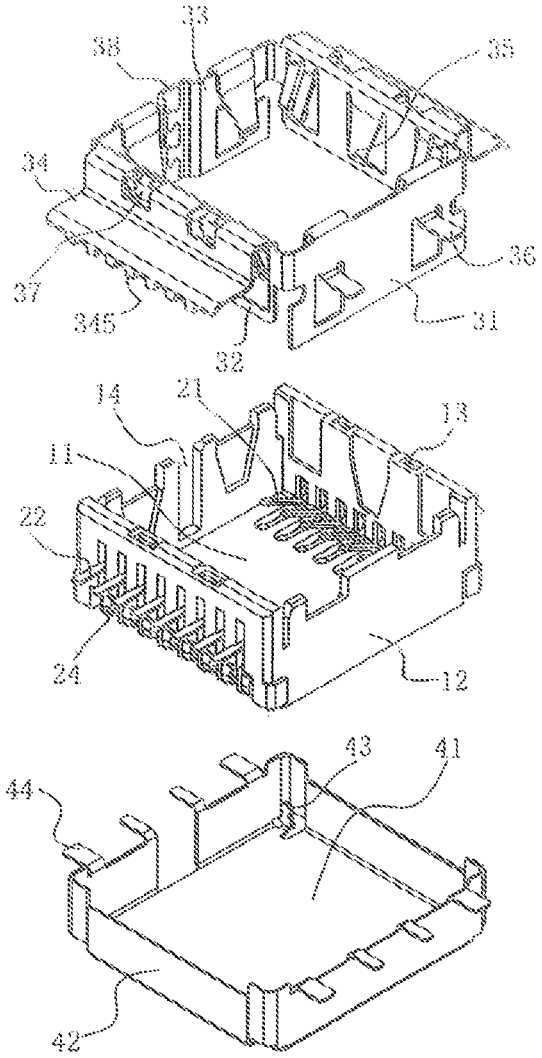
FIG. 6 is a further exploded perspective view of the embodiment depicted in FIG. 5.
Figure 7:
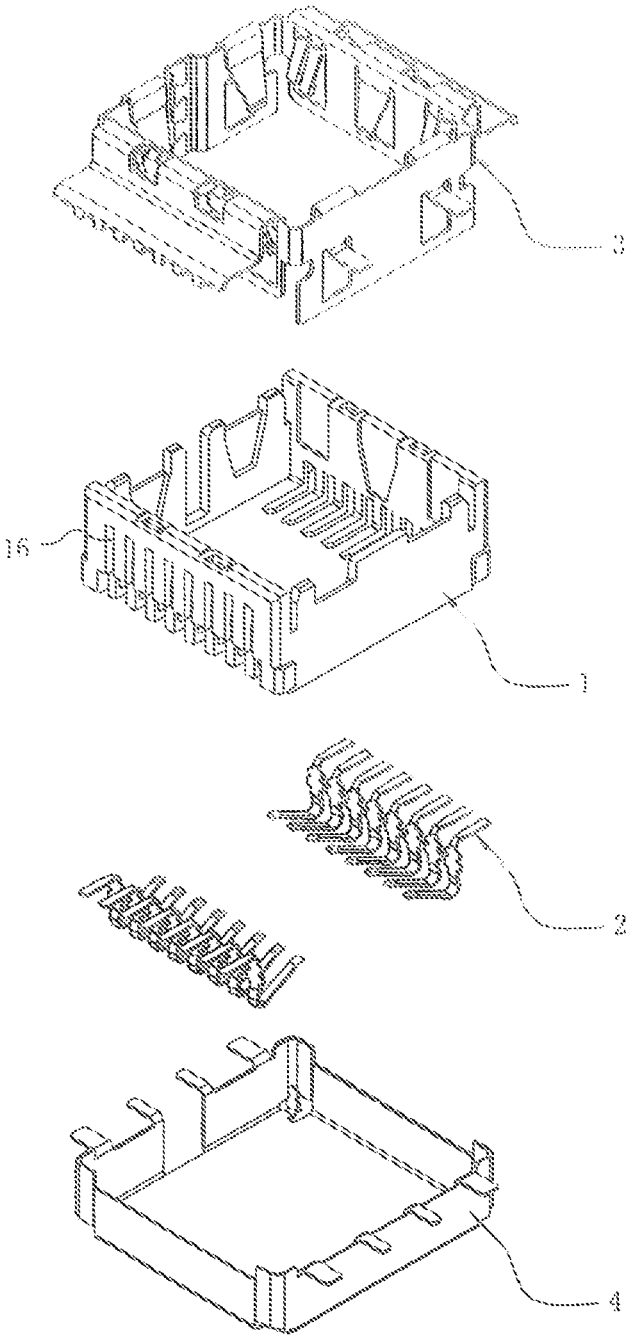
FIG. 7 is a still further exploded perspective view the embodiment depicted in FIG. 5.

Referring to FIG. 6 and FIG. 7, the housing 1 is manufactured by molding of insulating material, and comprises a bottom wall 11 and four sidewalls 12 extending upwards from the bottom wall 11. The bottom wall 11 and the four sidewalls 12 together form a receiving chamber 5 (referring to FIG. 1) at the middle of the housing 1 so as to correspondingly receive the electronic module. The housing 1 includes a plurality of upper card slots 13 on the top of two opposite sidewalls 12, and an opening 14 is provided on the top of a sidewall 12. Four corners of the bottom wall 11 are respectively arranged with a card slot 15. The housing 1 also arranges several terminal slots 16 on the bottom wall 11 and these two sidewalls 12 provided with card slots 13 thereon.

Figure 1:
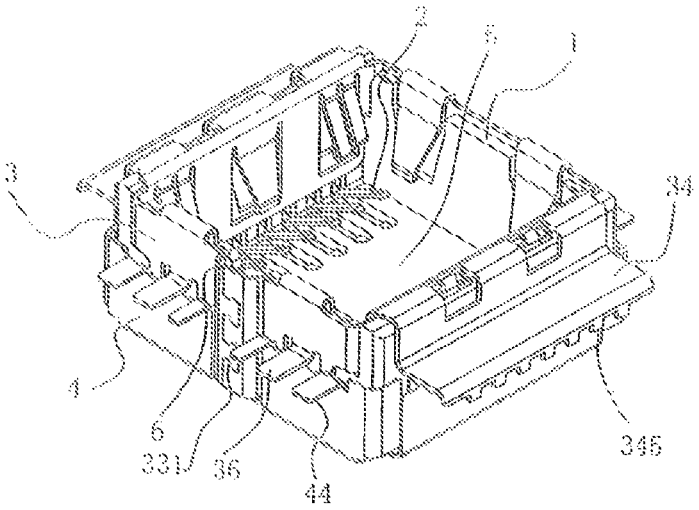
FIG. 1 is perspective view illustrating an embodiment of an electrical connector.
Figure 2:
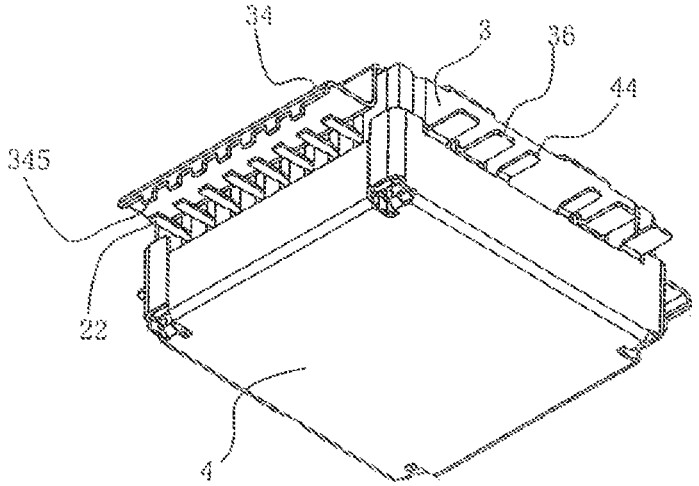
FIG. 2 is another perspective view illustrating the electrical connector depicted in FIG. 1.
Figure 3:
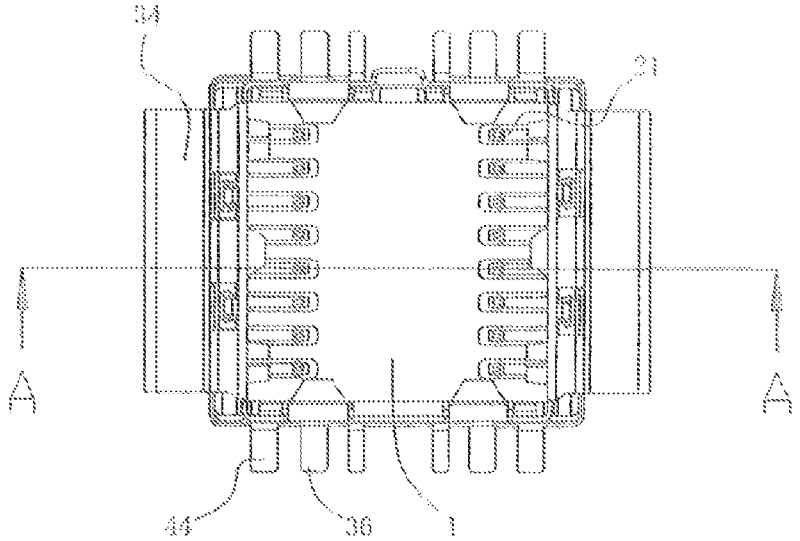
FIG. 3 is a top view of an embodiment of an electrical connector.
Figure 4:
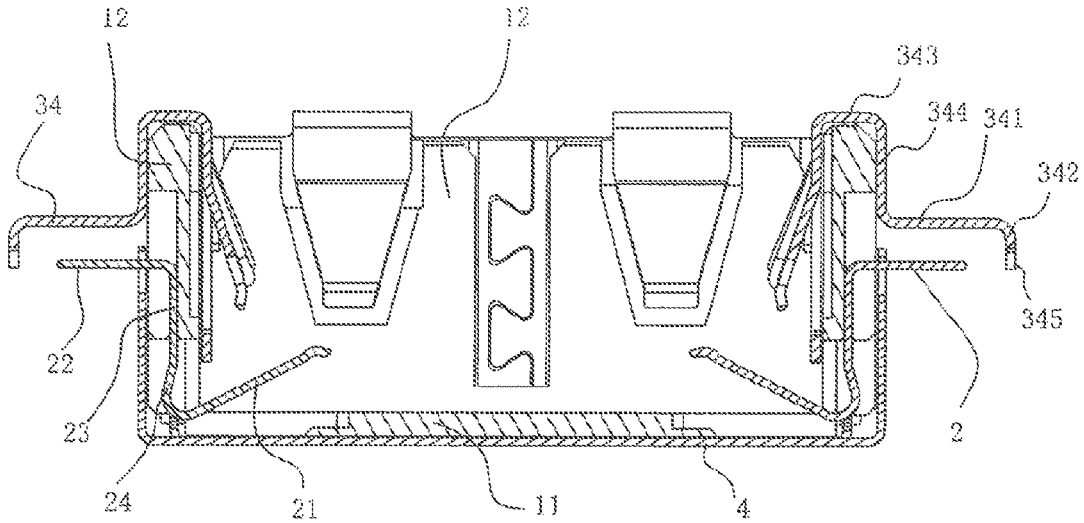
FIG. 4 is a sectional view taken along line A-A of FIG. 3.
Figure 5:
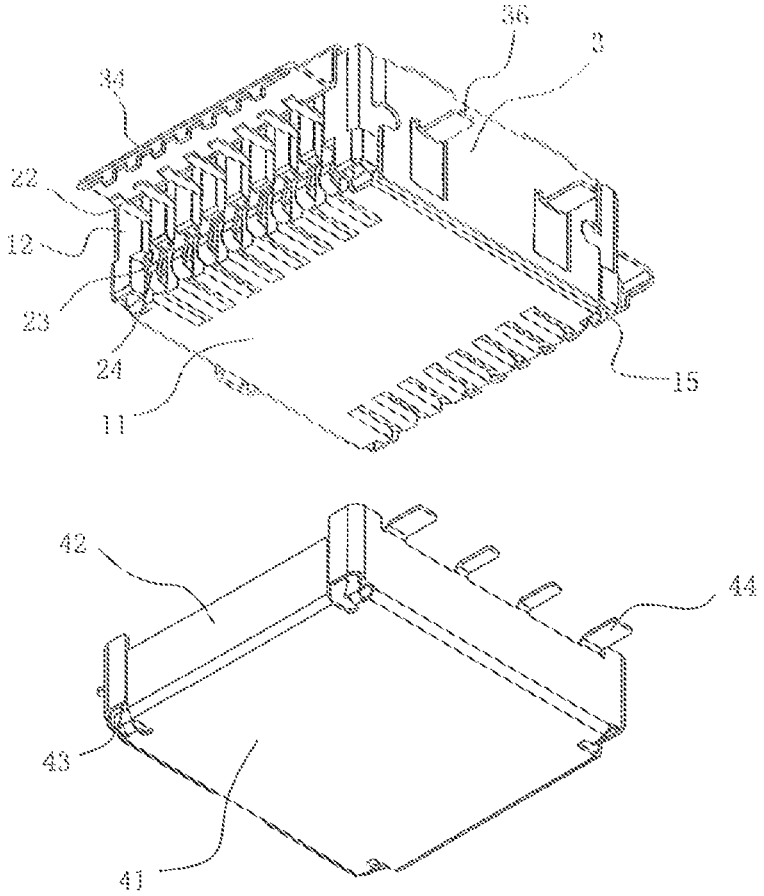
FIG. 5 is an exploded perspective view illustrating an embodiment of an electrical connector.
Figure 8:
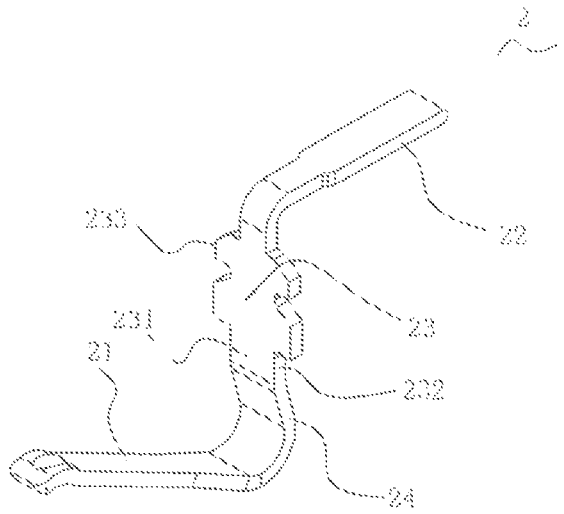
FIG. 8 is a perspective view illustrating an embodiment of a terminal.
Figure 9:
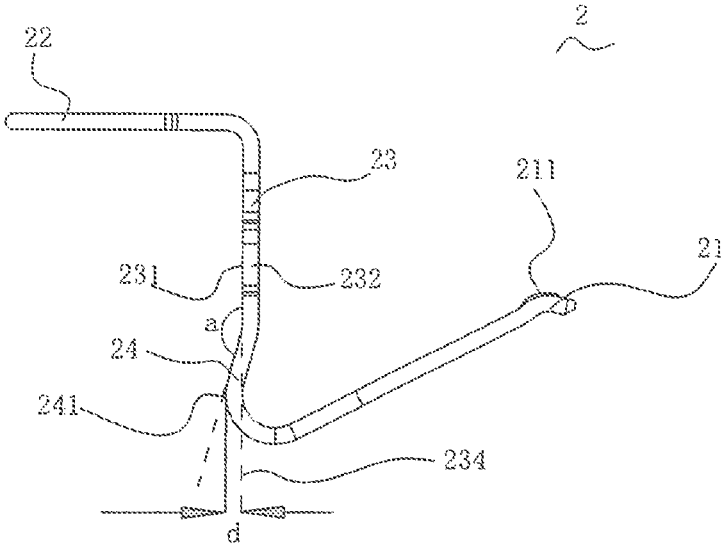
FIG. 9 is a side view of the terminal depicted in FIG. 8.

Referring to FIG. 4, FIG. 8 and FIG. 9, these terminals 2 are manufactured by forming and shaping metal sheets, and are correspondingly stitched into terminal slots 16 of the housing 1. Each of the terminals 2 comprises a securing portion 23, the securing portion 23 extends along the vertical direction and is provided with a plurality of bumps 233 in a direction perpendicular to the plane of the Figure so as to fix the terminal 21 to the housing 1; a soldering portion 22 which extends horizontally from the upper end of the securing portion 23 to a first side (left side in FIG. 9), and its tail end can be soldered to a circuit board (not shown in the Figures); an arc bending portion 24, the arc bending portion 24 bends and extends from the lower end of the securing portion 23 to the first side, and then bends and extends to a second side (right side in FIG. 9) opposite to the first one to form a hook shape; and a contact portion 21, which extends obliquely and upwards from the tail end of the arc bending portion 24 to the second side. It should be noted that the securing portion 23 comprises two first surfaces 231 with plane face of wider width and two the second surfaces 232 with plane face of narrower width (connecting these two first surfaces). In the preferable embodiment, the bumps 233 on the securing portion 23 respectively extend from two second surfaces 232 of the securing portion 23 along a direction perpendicular to the second surfaces 232, and can fix the terminal 2 onto the two sidewalls 12 of the housing 1. It should be noted that the bumps of another embodiment (not shown in the Figures) can also extend from the first surface 232 of the securing portion 23 along a direction perpendicular to the first surfaces 232. As can be appreciated, the disclosed relationships between the first side and the left side and between the second side and the right side are merely exemplary and are used to facilitate the explanation of the terminal 2 with respect to FIG. 9 but are not intended to be limiting.

As shown in FIG. 9, in order to more specifically explain the shape of the arc bending portion 24, an imaginary plane 234 is defined by the first surfaces 231, which face the first side, of the securing portion 23. The imaginary plane 234 is demonstrated in FIG. 9 as an elongated line vertically extending downwards from the first surfaces 231. The arc bending portion 24 is illustrated by means of the imaginary plane 234; the arc bending portion 24 first extends towards left side of the securing portion 23, and then curves and extends towards right side of the securing portion 23. Thus, a portion of the arc bending portion 24 is located at the first side (left side in FIG. 9) of the imaginary plane 234, and another portion is located at a second side (right side in FIG. 9) of the imaginary plane 234. A surface of the arc bending portion 24, which faces the surface of the first side, is a smooth curved face 241; wherein a turning angle is smaller than 180° and larger than 90° (for example, between 175° and 120°, and about 160° as depicted) is formed between the smooth curved face 241 and the first surfaces 231 of the securing portion 23 which face the first side. The position of the leftmost edge (i.e. a turning point where the arc bending portion 24 changes from extending leftwards into extending rightwards) of the smooth curved face 241 is located at the first side of the imaginary plane 234 of the securing portion 23, and deviates from the imaginary plane 234 by a set distance d.

Preferably, a contact bump 211 with a convex shape is provided at the tail end of the contact portion 21, and the contact bump 211 can, in operation, enhance the connection between the terminal 2 and the electronic module. As can be appreciated, the contact portion 21 extends obliquely and upwardly into the receiving chamber 5 and is configured to be flexibly engaged. The soldering portion 22 horizontally extends to the outside of the upper cage 3. The bumps 233 of the securing portion 23 can be correspondingly inserted into and fixed into the terminal slots 16 of the housing 1.

Figure 10:
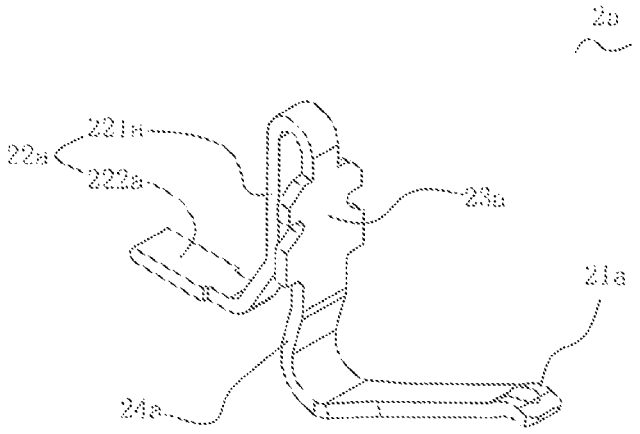
FIG. 10 is a perspective view illustrating an embodiment of a terminal.
Figure 11:
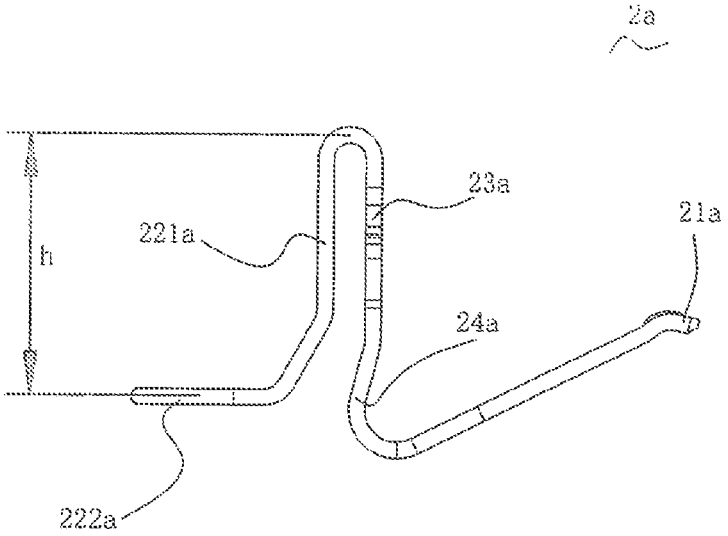
FIG. 11 is a side view of the terminal depicted in FIG. 10.
Figure 12:
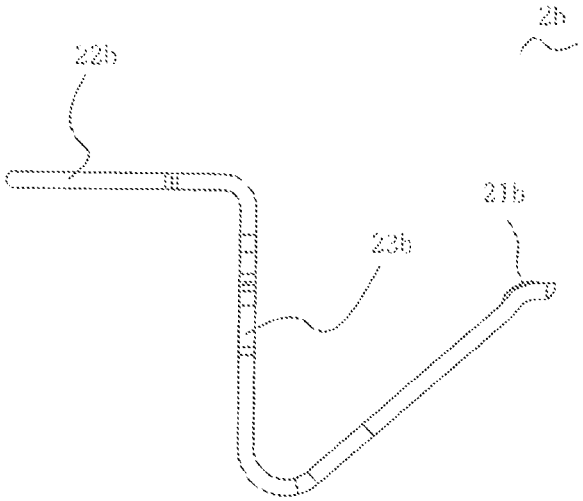
FIG. 12 (Prior Art)
FIG. 12 is a side view of a prior art terminal.
Figure 13:
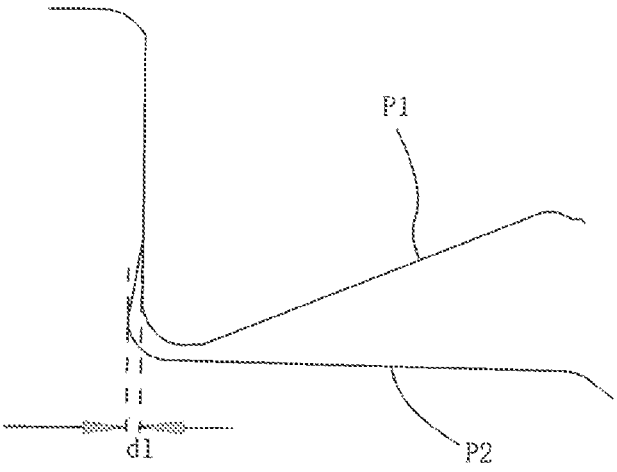
FIG. 13 (Prior Art)
FIG. 13 is a schematic illustration of the terminal depicted in FIG. 12 under two different states, wherein P1 indicates an original state when an electronic module is not plugged in and P2 indicates a flexed state after the electronic module is plugged in, and dl indicates the lateral offset.

Referring to FIG. 10 and FIG. 11, in another embodiment the terminal 2*a* includes the securing portion 23*a*, the arc bending portion 24*a* and the contact portion 21*a* similar to the structure in the above terminal 2, each of the terminals 2*a* specifically modifies the structure of the soldering portion 22*a* appropriately so as to flexibly adjust the height of the soldering plane. The soldering portion 22*a* comprises a connecting section 221*a* which extends from the upper end of the securing portion 23*a* and bends downward and a soldering section 222*a* which extends horizontally from the lower end of the connecting section 221*a*. The soldering section 222*a* can be soldered onto a circuit board (not shown in the Figures). Such structure of the soldering portion 22*a* can flexibly adjust height of the soldering plane (i.e. bottom face of the soldering section 222*a*) by changing height h of the connecting section 221*a*, and similarly, by changing the length of the soldering section 222*a*, the size of the soldering portion 22*a* that extends outside the receiving chamber 5 can be adjusted.

Referring to FIG. 4 and FIG. 6 in combination, the upper cage 3 is manufactured by integrally punching and buckling a metal sheet, and is mounted on the upper periphery of the housing 1. The upper cage 3 comprises the four sidewalls arranged to form an opening, and the opening has the shape of a square. Specifically, the upper cage 3 comprises a first sidewall 31, two second sidewalls 32 respectively extending from both sides of the first sidewall 31, and third sidewalls 33 which oppositely extend from the tail ends of these two second sidewalls 32 and are combined as a whole. A connecting gap 331 is formed on the third sidewalls 33. Wherein, two opposite second sidewalls 32 are respectively provided with a first shielding structure 34. The first shielding structure 34 comprises a second horizontal extending portion 343 outwards extending from the top of the sidewalls 32 where the first shielding structure 34 is located, a second vertical extending portion 344 extending downwards from the tail end of the second horizontal extending portion 343, a first horizontal extending portion 341 extending further outwards from the tail end of the second vertical extending portion 344, a first vertical extending portion 342 extending further downwards from the tail end of the first horizontal extending portion 341, and a plurality of grounded legs 345 protruded from the tail end of the first vertical extending portion 342. The first horizontal extending portion 341 and the first vertical extending portion 342 cover the top of the soldering portion 22 of the terminal 2 so as to shield electromagnetic radiation leaked from the soldering portion 22. These grounded legs 345 can be correspondingly soldered to grounded wires of a circuit board (not shown in the Figures), so that the first shielding structure 34 can obtain the good effect of being grounded, so as to shield the soldering portion 22 of the terminal 2 better. Specifically, in a preferable embodiment, the second vertical extending portion 344 closely sticks to the outer surface of the sidewalls 12 of the housing 1, thus such structure can further save the space, while in other embodiments (not shown in the Figures), the second horizontal extending portion 343 and the second vertical extending portion 344 can be omitted, so that the first horizontal extending portion 341 directly extends from a top end of the sidewalls 32 where the first shielding structure locates, and the sidewall 12 of the first vertical extending portion 342 which faces the housing 1 is made to keep a sufficient distance, which exceeds a dimension of the soldering portion 22 of the terminal 2 that extends outside. Relatively, such structure will make the whole electrical connector occupy a large space.

The upper cage 3 is provided with a plurality of elastic sheets 35 on all the four sidewalls, which downwards and obliquely extend into the receiving chamber 5. Those elastic sheets 35 can be correspondingly clamped on the electronic module in the receiving chamber 5. The upper cage 3 is provided with two outward extending grounded legs 36 at the middle portion of the first side wall 31 and two outward extending grounded legs 36 at the middle portion of the third sidewalls 33. The upper cage 3 is also provided with two fixing sections 37 respectively bending and extending downwards from the top of these two second side walls 32. These two fixing sections 37 can be correspondingly inserted into the card slots 13 on the housing 1, while the upper cage 3 is fixed onto the housing 1. The upper cage 3 can also be formed with a protrusion 38 projecting outwards at the middle of the third sidewalls 33, and the protrusion 38 corresponds to the opening 14 of the sidewalls 12 of the housing 1, so as to form a positioning chamber 6 in communication with the receiving chamber 5, so that a positioning mechanism on the electronic module can be correspondingly matched and connected.

The lower cage 4 can also be manufactured by forming and shaping a metal sheet, and is mounted on the lower periphery of the housing 1. The lower cage 4 can cooperate with the upper cage 3, and thus can form a shielded space (not shown in the Figures) which accommodates the housing 1 therein and has an opening on the top. The lower cage 4 comprises a bottom wall 41, four sidewalls 42 extending vertically and upwardly from four sides of the bottom wall 41, four fixing sections 43 extending vertically and upwardly from four corners of the bottom wall 41 for inserting them into the housing 1, and four grounded legs 44 respectively extending outwards from the top of two opposite sidewalls 42.

The assembling process of the electrical connector of the invention roughly comprises: forming the terminals 2, inserting the terminal 2 from below of the housing 1 into terminal slots 16 of the housing 1; then installing the upper cage 3 onto the upper periphery of the housing 1; and then installing the lower cage 4 onto the lower periphery of the housing 1

The electrical connector and the terminal of the invention additionally provide an arc bending portion 24, 24*a* which firstly bends and extends towards the first side and then bends and extends towards the second side, between the securing portion 23, 23*a* of the terminal 2, 2*a* and the contact portion 21, 21*a*, and comparison of the results of their resultant performance and the performance of the terminal of prior art example can be found in the following table.

| | the yield amount (%) | the elastic contact force (gf) | the lateral offset (mm) |
|---|---|---|---|
| Disclosed embodiment | 11.2 | 67 | 0.13 |
| terminal of prior art | 37.5 | 55 | 0.27 |
| Difference | −26.3 | +12 | −0.14 |

It can be seen from the above table that, compared with the terminal 2*b* of the prior art, the terminal 2, 2*a* depicted herein can significantly reduce the yield amount of the terminal 2, 2*a*, and can reduce the lateral offset caused by outward deformation of the terminal 2, 2*a*, and can further enhance the contact force with respect to the electronic module, so as to ensure stable electrical connection with the electronic module.

Above contents are only preferred embodiments of the invention rather than embodiments used to limit the invention, and various modifications and changes can be easily made by those skilled in the art based on the main principles and spirit of the invention, thus the scope of protection of the invention is defined only by the scope of protection of the claims.

The invention claimed is:

1. A terminal, comprising:

a securing portion extending along the vertical direction and including a plurality of bumps configured to secure the terminal to a housing;

a soldering portion that extends from an upper end of the securing portion to a first side;

an arc bending portion, the arc bending portion positioned on a lower end of the securing portion, the arc bending portion extending toward the first side, and then extending around a curve to a second side opposite to the first side, the arc bending portion having a hook shape; and a contact portion that extends obliquely and upwards from the arc bending portion, wherein the securing portion includes a first surface facing the first side, the first surface defining an imaginary plane, wherein a part of the arc bending portion is located at a first side of the imaginary plane, and another part is located at a second side of the imaginary plane, wherein a surface of the arc bending portion which faces the first surface is a curved face and the terminal is configured so that an angle of between 90 degrees and 180 degrees is formed between the curved face and the first surface.

2. The terminal according to claim 1, wherein the soldering portion of the terminal horizontally extends from the upper end of the securing portion towards the first side.

3. The terminal according to claim 1, wherein the soldering portion of the terminal includes a connecting section which is curved and extends downward from the upper end of the securing portion and a soldering section which extends horizontally from the connecting section.

4. An electrical connector, comprising:

a housing;

a plurality of terminals, each of the terminals secured by the housing and each terminal including:

a securing portion extending along the vertical direction and including a plurality of bumps configured to secure the terminal to the housing;

a soldering portion that extends from an upper end of the securing portion to a first side;

an arc bending portion, the arc bending portion positioned on a lower end of the securing portion, the arc bending portion extending toward the first side, and then extending around a curve to a second side opposite to the first side, the arc bending portion having a hook shape; and a contact portion that extends obliquely and upwards from the arc bending portion; and a cage fixed to the periphery of the housing, wherein a receiving chamber is provided at the middle of the housing so as to correspondingly receive an electronic module, wherein the soldering portions of the terminals extends outwards from the cage, and the contact portions of the terminals extends inwards into the receiving chamber, wherein the cage comprises an upper cage and a lower cage and the upper cage comprises four sidewalls arranged to form an opening and a first shielding structure arranged on at least one of the sidewalls, the first shielding structure including a first horizontal extending portion and a first vertical extending portion and the first shielding structure covers the top of the soldering portion of the terminal so as to shield the soldering portion, wherein a top edge of one sidewall of the upper cage firstly horizontally extends outwards so as to form a second horizontal extending portion, and then vertically extends downwards from outer edge of the second horizontal extending portion so as to form a second vertical extending portion and the second vertical extending portion contacts and extends along the housing; where a lower edge of the second vertical extending portion further extends so as to form the first horizontal extending portion and the first vertical extending portion, and a plurality of grounded legs are provided downwards at bottom edge of the first vertical extending portion.

* * * * *